US011913437B2

(12) United States Patent
Reukers et al.

(10) Patent No.: US 11,913,437 B2
(45) Date of Patent: Feb. 27, 2024

(54) PUMPING SYSTEMS

(71) Applicant: QUANTUM SERVO PUMPING TECHNOLOGIES PTY LTD, Campbellfield (AU)

(72) Inventors: Darren Reukers, Campbellfield (AU); Peter Harding, Campbellfield (AU)

(73) Assignee: QUANTUM SERVO PUMPING TECHNOLOGIES PTY LTD, Campbellfield (AU)

( * ) Notice: Subject to any disclaimer, the term of this patent is extended or adjusted under 35 U.S.C. 154(b) by 16 days.

(21) Appl. No.: 17/972,022

(22) Filed: Oct. 24, 2022

(65) Prior Publication Data

US 2023/0120606 A1 Apr. 20, 2023

Related U.S. Application Data

(63) Continuation of application No. 16/757,682, filed as application No. PCT/AU2018/051202 on Nov. 8, 2018, now abandoned.

(30) Foreign Application Priority Data

Nov. 10, 2017 (AU) ..... 2017904566

(51) Int. Cl.
*F04B 23/04* (2006.01)
*F04B 1/00* (2020.01)
(Continued)

(52) U.S. Cl.
CPC ..... *F04B 23/04* (2013.01); *F04B 1/00* (2013.01); *F04B 9/02* (2013.01); *F04B 11/005* (2013.01);
(Continued)

(58) Field of Classification Search
CPC .... F04B 1/00; F04B 1/063; F04B 9/02; F04B 11/005; F04B 11/0075; F04B 11/0083;
(Continued)

(56) References Cited

U.S. PATENT DOCUMENTS 4,643,651 A 2/1987 Couillard
4,681,513 A 7/1987 Saito et al.
(Continued)

FOREIGN PATENT DOCUMENTS

GB 1450766 A 9/1976

OTHER PUBLICATIONS

International Search Report dated Dec. 20, 2018 for corresponding International Application No. PCT/AU2018/051202, filed Nov. 8, 2018.

(Continued)

*Primary Examiner* — Devon C Kramer
*Assistant Examiner* — Joseph S. Herrmann
(74) *Attorney, Agent, or Firm* — David D. Brush; Westman, Champlin & Koehler, P.A.

(57) ABSTRACT

A system and method for pumping fluid. The system includes a sequence of two or more positive-displacement sub-systems each having a respective one-way inlet. A respective one-way flow path links each adjacent two of the sub-systems. A one-way outlet from a last of the sub-systems is provided. The system is capable of a mode of operation in which at least some of the sub-systems are substantially in phase with respect to each other to cause the system to draw fluid from more than one of the one-way inlets; and another other mode of operation in which at least some of the sub-systems are substantially in antiphase with respect to each other to increment a pressure of the fluid as the fluid moves along the sequence.

20 Claims, 5 Drawing Sheets

(51) Int. Cl.

| | |
|---|---|
| ***F04B 9/02*** | (2006.01) |
| ***F04B 11/00*** | (2006.01) |
| ***F04B 41/06*** | (2006.01) |
| ***F04B 49/06*** | (2006.01) |
| *F04B 43/02* | (2006.01) |

(52) U.S. Cl.
CPC ..... *F04B 41/06* (2013.01); *F04B 49/065* (2013.01); *F04B 11/0075* (2013.01); *F04B 43/02* (2013.01)

(58) Field of Classification Search
CPC ..... F04B 23/06; F04B 23/08; F04B 23/10; F04B 23/106; F04B 27/0673; F04B 41/06; F04B 43/02; F04B 49/005; F04B 49/007; F04B 49/06; F04B 49/065; F04B 49/12; F04B 2203/0205
USPC ..... 417/62
See application file for complete search history.

(56) References Cited

U.S. PATENT DOCUMENTS 5,056,036 A * 10/1991 Van Bork ..... G05D 7/005 700/282
5,088,898 A 2/1992 Fukumoto et al.
5,158,436 A * 10/1992 Jensen ..... H02H 7/0833 417/32
6,139,288 A * 10/2000 Karasawa ..... F04B 17/042 417/415
6,244,838 B1 6/2001 Couillard et al.
6,923,916 B1 8/2005 Hiraku et al.
9,212,657 B2 12/2015 Reukers
9,618,485 B2 * 4/2017 Witt ..... F04B 11/0058
10,584,696 B2 * 3/2020 Reid ..... E21B 33/061
2008/0101970 A1 5/2008 Witt et al.
2013/0167697 A1 * 7/2013 Reukers ..... B26F 3/004 83/53

OTHER PUBLICATIONS

Written Opinion of the International Searching Authority dated Dec. 20, 2018 for corresponding International Application No. PCT/AU2018/051202, filed Nov. 8, 2018.
Final Office Action for U.S. Appl. No. 16/757,682, dated Jul. 29, 2022.
Office Action for U.S. Appl. No. 16/757,682, dated Feb. 18, 2022.
Requirement for Restriction-Election for U.S. Appl. No. 16/757,682, dated Aug. 13, 2021.

* cited by examiner

100
A
B
C
D
5
6
7
139
145
147A
147AB
147DC
147CD
147D
15A
15'A
15B
15'B
15'C
15D
17'
17D
115A
115B
117AB
135AB
137AB
17B
133AB
141AB
143AB
17A

PUMPING SYSTEMS

CROSS-REFERENCE TO RELATED APPLICATIONS

This Application is a continuation of U.S. application Ser. No. 16/757,682, filed Apr. 20, 2020, which is a Section 371 National Stage Application of International Application No. PCT/AU2018/051202, filed Nov. 8, 2018, published as WO 2019/090388 A1 on May 16, 2019, in English, the contents of which are hereby incorporated by reference in their entireties.

FIELD OF THE INVENTION

The invention relates to pumping fluid.

BACKGROUND TO THE INVENTION

Pumps are often required to work against varying resistances. The resistance is often measured in terms of the pressure at the outlet of the pump, although similar issues arise in the context of vacuum pumps, the outlets of which might be exposed to atmosphere. By way of example, in the context of a pump pumping a gas into a vessel, the pressure will rise as a function of the volume of gas pumped.

Accordingly, it is desirable for a pump to be capable of efficiently delivering fluid for a range of resistances.

With the foregoing in mind, the present invention aims to provide improvements in and for pumping fluid, or at least to provide alternatives for those concerned with pumping fluid.

SUMMARY

One aspect of the invention provides a system, for pumping fluid, including

- a sequence of two or more positive-displacement sub-systems each having a respective one-way inlet;
- a respective one-way flow path linking each adjacent two of the sub-systems; and
- a one-way outlet from a last of the sub-systems;
- the system being capable of
  - one mode of operation in which at least some of the sub-systems are substantially in phase with respect to each other to cause the system to draw the fluid from more than one of the one-way inlets; and
  - one other mode of operation in which at least some of the sub-systems are substantially in antiphase with respect to each other to increment a pressure of the fluid as the fluid moves along the sequence.

In the one mode of operation all of the sub-systems may be substantially in phase with respect to each other. In the one other mode of operation the sub-systems of each adjacent two of the sub-systems may be substantially in antiphase with respect to each other to increment the pressure through each of the sub-systems.

Preferably, in at least one of the one mode of operation and the one other mode of operation, a stroke length of at least one of the sub-systems is longer than a stroke length of another of the sub-systems downstream of the at least one of the sub-systems.

Two or more, or preferably all, of the sub-systems may be substantially identical to each other.

Optionally, at least one of the sub-systems has a variable stroke length. A ratio, of a stroke length of one of the sub-systems to a stroke length of another of the sub-systems downstream of the one of the sub-systems, may be lower for the one mode than the ratio is for the one other mode.

The system may include a control arrangement configured to control at least some of the sub-systems.

The control arrangement may be configurable to cause the system to respond to feedback to deliver a target pressure when the system is in at least one of the one mode of operation and the one other mode of operation.

The control arrangement may be configurable to cause the system to respond to feedback to deliver a target flow rate when the system is in at least one of the one mode of operation and the one other mode of operation.

The control arrangement may be configurable to cause the system to respond to feedback, to maximise a delivery of the system whilst maintaining one or more parameters of the system within one or more respective limits, when the system is in at least one of the one mode of operation and the one other mode of operation.

The limits may be selected to protect the system. The control arrangement is preferably configurable to cause the system to respond to feedback to transition from the one mode of operation to the one other mode of operation.

The control arrangement may be configurable to cause the system to respond to feedback to equalise at least one parameter of one of the sub-systems with a corresponding parameter of at least one other of the sub-systems.

Another aspect of the invention provides a method of operating the system including causing the system to transition from the one mode to the one other mode.

Another aspect of the invention provides an arrangement, for pumping fluid, including

- a first system;
- a second system; and
- pumps each of which includes
  - a respective sub-system of the first system;
  - a respective sub-system of the second system;
  - a respective drive arrangement for driving the respective sub-systems in antiphase to each other.

The arrangement may include the control arrangement of the first system configured to control the second system.

Another aspect of the invention provides a system, for pumping fluid, including

- a first pumping chamber;
- a second pumping chamber;
- an outlet path for conveying output of the first pumping chamber and the second pumping chamber;
- the second pumping chamber being operable
  - in antiphase to the first pumping chamber; and
  - in phase with the first pumping chamber;
- a fluid path connecting the first pumping chamber to the second pumping chamber to enable the first pumping chamber to supply power to the second pumping chamber
- when the second pumping chamber is operated in antiphase to the first pumping chamber; and
- a mechanism by which the power is utilised to pump fluid.

The system may include a third pumping chamber. The mechanism may be a transmission for transmitting the power to the third pumping chamber. The transmission may be a reciprocally driven unit. The unit may include a screw. The system may include

- a nut engaged with the screw; and
- a drive for rotationally driving the nut.

A one-way inlet, and a one-way outlet, may be associated with the fluid path such that operation of the second pump chamber in phase with the first pumping chamber pumps fluid from the one-way inlet to the one-way outlet.

Alternatively, the first pumping chamber and the second pumping chamber may each have a respective one-way inlet;

the fluid path may be a one-way fluid path from the first pumping chamber to the second pumping chamber; and the second pumping chamber may have a one-way outlet path.

Another aspect of the invention provides a system, for pumping fluid, including a pressure space partly defined by a first movable element; and a second movable element;

a one-way inlet, and a one-way outlet, associated with the pressure space;

a drive arrangement for in one mode of operation moving the first movable element and the second movable element substantially in phase with respect to each other to pump fluid from the one-way inlet to the one-way outlet; and in one other mode of operation moving the first movable element and the second movable element substantially in antiphase with respect to each other so that the first movable element supplies power to the second movable element;

a mechanism by which the power is utilised to pump fluid.

Another aspect of the invention provides a system, for pumping fluid, including two or more positive-displacement sub-systems connected so as to be capable of one mode of operation in which at least some of the sub-systems are substantially in phase with respect to each other; and one other mode of operation in which at least some of the sub-systems are substantially in antiphase with respect to each other to build more pressure than in the one mode of operation.

Another aspect of the invention provides a pump including a pump chamber;

a fluid-displacing portion;

a drive arrangement for stroking the fluid-displacing portion along a stroke relative to the pump chamber to pump fluid; and a control arrangement configured to shift at least one end point of the stroke.

The at least one end point may be an end point of a compression stroke. The control arrangement is preferably configured to so shift in response to feedback. The feedback may be or include feedback from the drive arrangement.

Preferably the pump has a first stage and a second stage, and a flow path serially connecting the first stage to the second stage. A heat exchanger may be along the flow path to cool the fluid. The stroke may be a stroke of the first stage. The shift may be to limit or regulate a temperature of one of the first stage and the second stage. Preferably the first stage is the one of the first stage and the second stage. The control arrangement may be configured to vary a stroke rate of the pump to regulate a temperature of the other of the first stage and the second stage. The shift may be to relatively control a temperature of the first stage relative to a temperature of the second stage. In one example the shift is to equalise a temperature of the first stage with a temperature of the second stage. In one example, the shift is to allow the second stage to achieve maximum pump output performance without exceeding a pressure limit of the first stage. The shift may be to further balance other aspects of the system. In one example, the average load on each end may be balanced to achieve equal wear and loading on either end to maximise product life.

Preferably the drive arrangement is configured to drive the first stage and the second stage in antiphase to each other. The drive arrangement preferably includes a reciprocally-driven unit having a first end arranged to drive the first stage; and a second end arranged to drive the second stage. The reciprocally-driven unit may include a screw portion engaged with and driven by a rotationally-driven nut arrangement. The pump may include a stator coaxial to the screw portion to rotationally drive the nut arrangement.

The pump chamber may be stationary.

Another aspect of the invention provides a method of controlling a pump working against a varying resistance;

the pump including a unit relatively stroked along a stroke relative to a pump chamber; and the method including shifting an end point of the stroke to suit the varying pressure.

Preferably the pump includes a first stage and a second stage. The unit may be stroked to drive the first stage and the second stage in antiphase to each other. The pump may be pressurising a vessel.

DESCRIPTION OF EMBODIMENTS

Figure 1:
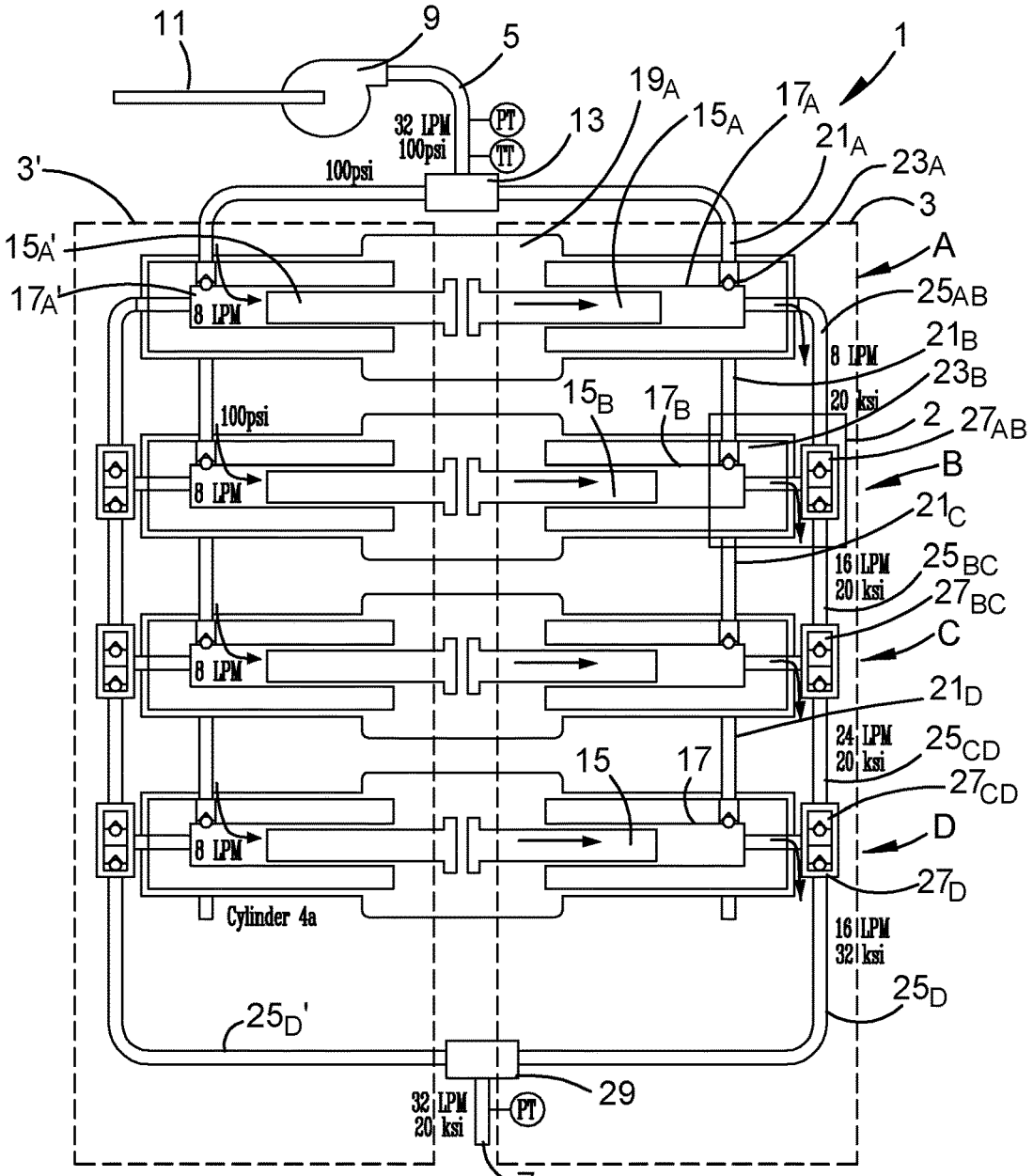
FIG. 1 illustrates a pumping arrangement in a first mode of operation.

The pumping arrangement 1 includes four double-acting positive-displacement pumps A, B, C, D shared between the two pumping systems 3, 3'. The system 3, 3' are plumbed in parallel between an inlet path 5 and an outlet path 7.

The arrangement 1 further includes another pump 9, in this case a centrifugal pump, for drawing fluid (in this case water) from an inlet path 11 and pressurising the inlet path 5. In this example the pump 9 provides 32 litres per minute at 100 psi to the inlet path 5. T-junction 13 divides the flow from the inlet path 5 between the systems 3, 3'.

The system 3 and pump A each include a movable element $\mathbf{15}_A$ for positively displacing fluid. In this example, the movable element $\mathbf{15}_A$ is a plunger carried within a cylinder $\mathbf{17}_A$. In another example the element movable within the cylinder may be a piston. In yet another example the movable element might take the form of a diaphragm.

The pump A is a substantially symmetrical double-acting pump having the plunger cylinder arrangement $\mathbf{15}_A$, $\mathbf{17}_A$ of the system 3 at one end and a plunger cylinder arrangement $\mathbf{15}_A'$, $\mathbf{17}_A'$ of the system 3' at its other end. The plungers $\mathbf{15}_A$, $\mathbf{15}_A'$ are mutually connected by a screw portion (not shown) so that the plungers $\mathbf{15}_A$, $\mathbf{15}_A'$ and screw portion together form a unit (i.e. an arrangement that is movable as a unitary body which may or may not be fully rigid).

The screw portion is part of a drive $\mathbf{19}_A$ by which the unit $\mathbf{15}_A$, $\mathbf{15}_A'$ is reciprocally driven, that is alternately stroked left and right as illustrated in FIG. 1. The drive $\mathbf{19}_A$ includes a nut arrangement engaged with the unit $\mathbf{15}_A$, $\mathbf{15}_A'$ and encircled by a stator coaxial to the screw portion. The stator co-operates with the nut arrangement to form an electric motor by which the nut arrangement is rotated. The nut arrangement co-operates with the screw portion to convert this rotation into linear movement of the unit $\mathbf{15}_A$, $\mathbf{15}_A'$. A suitable encoder is provided to provide feedback to a control arrangement of the motor whereby the motor is a servo motor.

Preferably the nut arrangement incorporates rolling elements. In this particular example, the nut arrangement and screw portion are together a ball screw. Other examples of the pump A may take different forms, e.g. the form of a double-acting hydraulic intensifier.

The piston cylinder arrangement $\mathbf{15}_A$, $\mathbf{17}_A$ constitutes a positive-displacement sub-system of the system 3. The sub-system has an inlet $\mathbf{21}_A$ by which fluid is supplied from the T-junction 13 to the sub-system $\mathbf{15}_A$, $\mathbf{17}_A$. The inlet $\mathbf{21}_A$ is equipped with a check valve $\mathbf{23}_A$ and thereby constitutes a one-way inlet. The pumps A, B, C, D are substantially identical to each other although in other examples they may be mutually different. Each pump's respective inlet is arranged to in at least one mode of operation draw fluid from the T-junction 13, e.g. inlet $\mathbf{21}_B$ of the pump B is arranged to draw fluid from the junction 13.

The pump B includes a plunger $\mathbf{15}_B$ and cylinder $\mathbf{17}_B$ together forming a sub-system $\mathbf{15}_B$, $\mathbf{17}_B$. The sub-system $\mathbf{15}_A$, $\mathbf{17}_A$ is connected to the sub-system $\mathbf{15}_B$, $\mathbf{17}_B$ by a flow path defined by a conduit. A check valve $\mathbf{27}_{AB}$ is mounted along the flow path $\mathbf{25}_{AB}$ whereby the flow path $\mathbf{25}_{AB}$ is a one-way flow path. Similar one-way flow paths $\mathbf{25}_{BC}$, mutually connect the pumps B, C and pumps C, D respectively whereby the portions shared by the pumps A, B, C, D and the system 3 form a sequence of sub-systems along which the fluid is pumped from the T-junction 13 to the outlet 7.

The pump D defines a last sub-system $\mathbf{15}_D$, $\mathbf{17}_D$ of the sequence. An outlet path $\mathbf{25}_D$ connects the sub-system $\mathbf{15}_D$, $\mathbf{17}_D$ to a T-junction 29. The T-junction 29 also opens to the outlet path $\mathbf{25}_D'$ to receive fluid from the system 3' and to the outlet. The flow path $\mathbf{25}_D$ is equipped with a check valve $\mathbf{27}_D$ and is thereby a one-way flow path.

Figure 2:
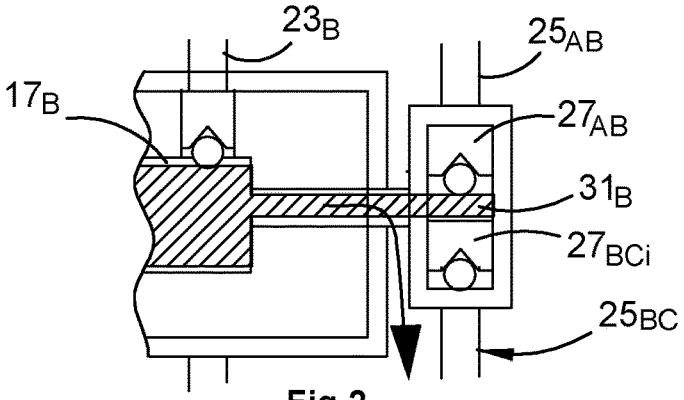
FIG. 2 is an enlargement of detail 2 from FIG. 1.

FIG. 2 illustrates a hatched region $\mathbf{31}_B$ corresponding to an internal pressure volume of the sub-system $\mathbf{15}_B$, $\mathbf{17}_B$ including an elongate portion extending through a tubular cavity from the plunger-receiving bore of the cylinder $\mathbf{17}_B$. The internal pressure volume $\mathbf{31}_B$ includes a portion connecting the flow path $\mathbf{25}_{AB}$ to the flow $\mathbf{25}_{BC}$. In this example the flow path $\mathbf{25}_{BC}$ is equipped with a check valve $\mathbf{27}_{BCI:}$ at its start in addition to the check valve $\mathbf{27}_{BC}$ at its end.

The check valve $\mathbf{23}_A$ is an inlet check valve to the sub-system $\mathbf{15}_A$, $\mathbf{17}_A$ whilst the check valve $\mathbf{27}_{AB}$ functions as an outlet check valve from that system whereby reciprocal movement of the plunger $\mathbf{15}_A$ within the cylinder $\mathbf{17}_A$ pumps fluid from the inlet $\mathbf{21}_A$ to the outlet $\mathbf{27}_{AB}$. In this example the plunger $\mathbf{15}_A$ is movable whilst the cylinder $\mathbf{17}_A$ is stationary although relative movement could be achieved in other ways, e.g. the plunger could be held stationary whilst the cylinder $\mathbf{17}_A$ is moved.

FIG. 1 illustrates a mode of operation in which each of the four sub-systems are operated in phase with respect to each other. At the moment illustrated in FIG. 1 the plungers 15 are simultaneously advancing towards the right-hand side on their respective compression strokes whereby each of the sub-systems of the system 3 simultaneously delivers about the same volume of water (8 litres per minute in this example) to about the same pressure (20 ksi in this example). During this phase of operation, the delivery of the sub-system $\mathbf{15}_A$, $\mathbf{17}_A$ passes through the internal pressure space $\mathbf{31}_B$ of the second sub-system $\mathbf{15}_B$, $\mathbf{17}_B$.

In this example the plungers $\mathbf{15}_A$, $\mathbf{15}_A'$ are part of a common unit and the cylinders $\mathbf{17}_A$, $\mathbf{17}_A'$ are fixed relative to each other whereby the sub-system $\mathbf{15}_A$, $\mathbf{17}_A$ always operates in antiphase to the sub-system $\mathbf{15}_A'$, $\mathbf{17}_A'$. As such in the moment illustrated in FIG. 1 each of the four sub-systems of the system 3' draws in about the same volume (in this case about 8 litres per minute) of fluid at about the same pressure (about 100 psi in this example).

The pump 9 supplies the systems 3, 3' with about 32 litres per minute at about 100 psi. At the moment illustrated in FIG. 1, the system 3 passes on that about 32 litres per minute at about 20 ksi to the outlet 7. When the pumps reach the end of the illustrated stroke and reverse their direction the arrangement 1 switches to the sub-system 3' pumping that volumetric rate at that pressure.

Figure 3:
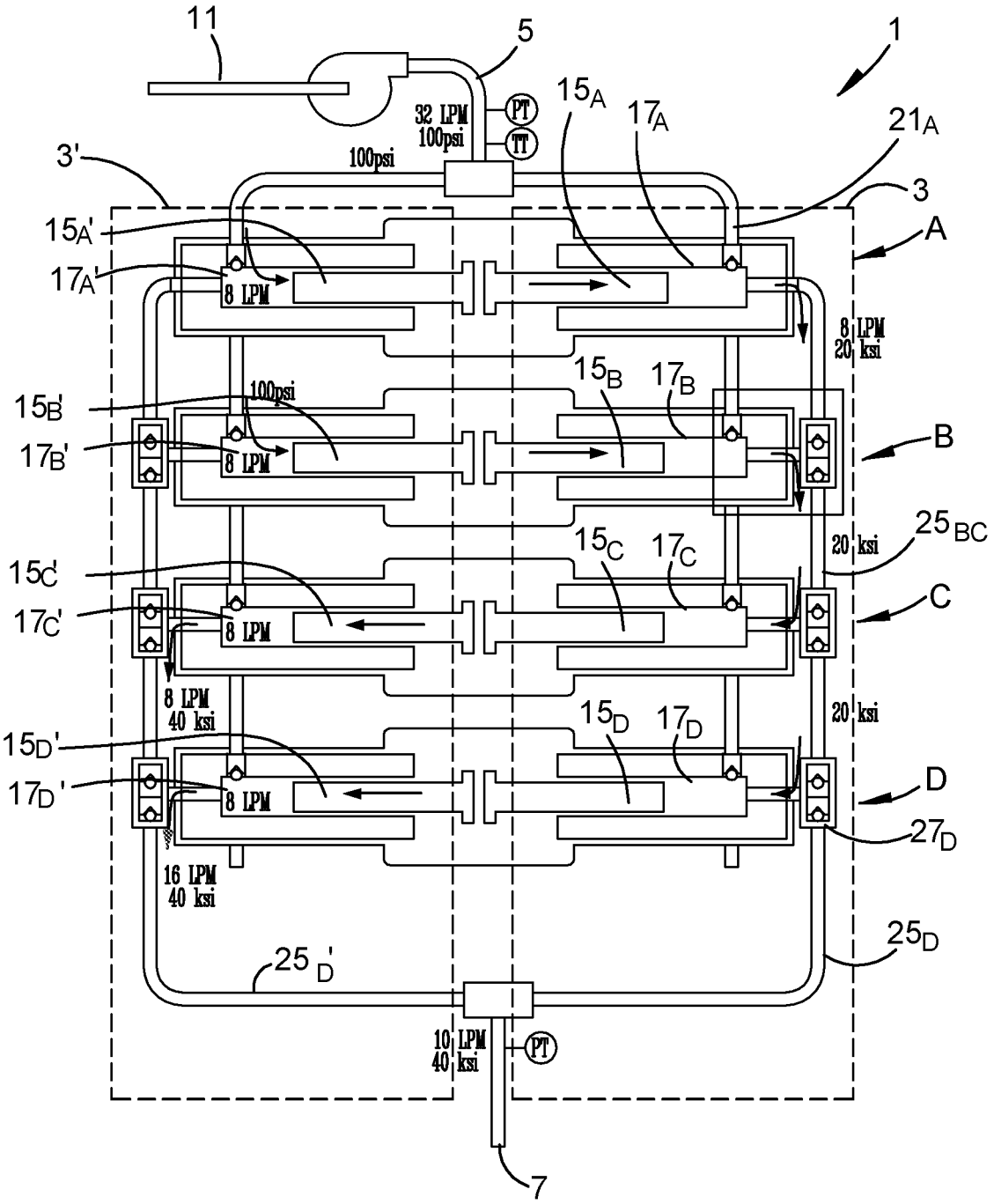
FIG. 3 illustrates the arrangement of FIG. 1 in a second mode of operation.

The mode of FIG. 1 is a high-flow low-pressure pumping mode in which the pumps A, B, C, D are effectively in parallel to each other. FIG. 3 illustrates an intermediate pressure, intermediate flow mode. Pumps A, B are operated in phase with respect to each other whilst the pumps C, D are operated in phase with respect to each other but in antiphase to the pumps A, B.

In the moment of FIG. 3 the sub-systems $\mathbf{15}_A$, $\mathbf{17}_A$ and $\mathbf{15}_B$, $\mathbf{17}_B$ are on their compression stroke to supply to the fluid path $\mathbf{25}_{BC}$ about 16 litres per minute at about ksi. The sub-systems $\mathbf{15}_C$, $\mathbf{17}_C$ and $\mathbf{15}_D$, $\mathbf{17}_D$ are on their intake strokes to receive the fluid from the path $\mathbf{25}_{BC}$.

A stroke length of the sub-systems $\mathbf{15}_C$, $\mathbf{17}_C$ and $\mathbf{15}_D$, $\mathbf{17}_D$ is reduced relative to a stroke length of the sub-systems $\mathbf{15}_A$, $\mathbf{17}_A$ and $\mathbf{15}_B$, $\mathbf{17}_B$ by an amount commensurate with the compressibility of the fluid between a pressure at the inlet $\mathbf{21}_A$ (100 psi in this example) and the desired line pressure along the conduit $\mathbf{25}_{BC}$ (20 ksi in this example). Accordingly, the two upstream sub-systems hydraulically power the two downstream sub-systems; the 20 ksi pressure does work on those sub-systems by pushing the plungers $\mathbf{15}_C$, $\mathbf{15}_D$ to the left as drawn in FIG. 3. The units $\mathbf{15}_C$, $\mathbf{15}_C'$ and $\mathbf{15}_D$, $\mathbf{15}_D'$ each constitutes a mechanism by which the power from the preceding sub-systems is utilised to pump fluid. In this example the 20 ksi pressure acting on the plunger $\mathbf{15}_C$ helps to move the unit $\mathbf{15}_C$, $\mathbf{15}_C'$ to the left as drawn whereby power from the sub-systems $\mathbf{15}_A$, $\mathbf{17}_A$ and $\mathbf{15}_B$, $\mathbf{17}_B$ is utilised to pump fluid from the sub-system $\mathbf{15}_C'$, $\mathbf{17}_C'$.

As such the pumps C, D are able to pump fluid to 40 ksi whilst the load borne by each of the drives $\mathbf{19}_C$, $\mathbf{19}_D$ corresponds to only 20 ksi corresponding to the 20 ksi pressure difference between the cylinders $\mathbf{17}_C$, $\mathbf{17}_D$ on the one hand and the cylinders $\mathbf{17}_C'$, $\mathbf{17}_D'$ on the other hand.

Accordingly, in the moment of FIG. 3 the first two sub-systems of the system 3' draws about 16 litres per minute at about 100 psi from the inlet 5 whilst the last two sub-systems of the system 3' delivers about 16 litres per minute at about 40 ksi to the outlet path $\mathbf{25}_D'$ with the assistance of 20 ksi of supporting pressure from the system 3. At the end of the illustrated stroke, the systems 3, 3' switch roles whereby the outlet 7 provides a delivery of about 16 litres per minute at about 40 ksi. The delivery is substantially continuous but for a pressure pulse associated with the stroke reversal. An accumulator may be provided to attenuate the pressure pulse.

Figure 4:
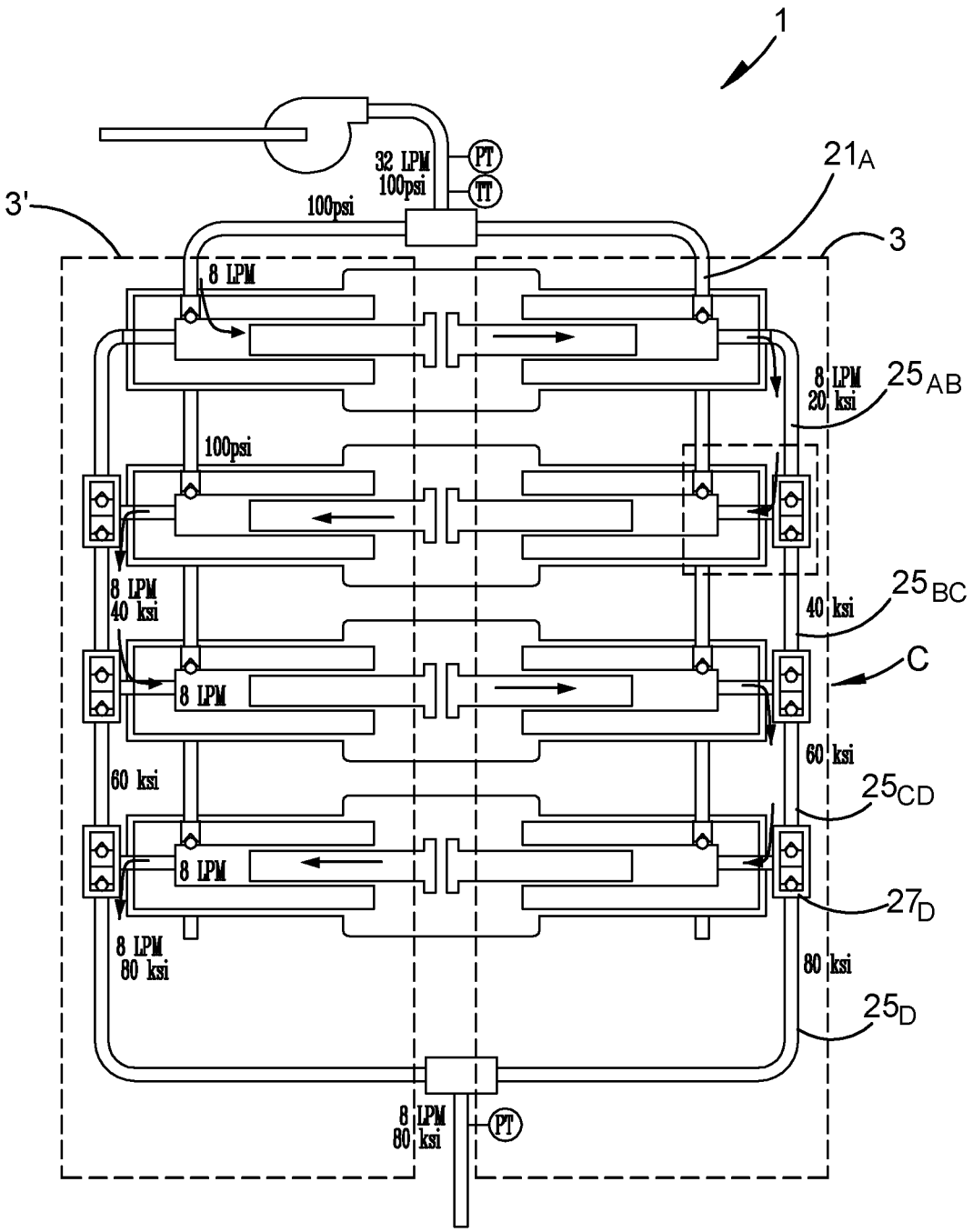
FIG. 4 illustrates the arrangement of FIG. 1 in a third mode of operation.

FIG. 4 illustrates a high-pressure low-flow mode in which the arrangement 1 delivers about 8 litres per minute at about 80 ksi. The pumps are effectively in series to each other. In this mode each adjacent two of the pumps A, B, C, D (and the sub-systems defined thereby) are operated in antiphase with respect to each other. From sub-system to sub-system the stroke length is incrementally reduced by an amount corresponding to the incremental compression of the fluid between the sub-systems. As such within the system 3, the pressure is incremented through the first sub-system to 20 ksi, through the second sub-system to 40 ksi, through the third sub-system to 60 ksi and through the fourth sub-system to 80 ksi in the outlet path $\mathbf{25}_D$. Each compression stroke is partly powered by fluid pressure from the corresponding intake stroke of the counterpart sub-system of the other system whereby again, each of the drive mechanisms sees resistance corresponding to the 20 ksi pressure difference across the two plungers with which it is associated.

Many variations of the illustrated principles are possible. By way of example, for applications for which 40 ksi is sufficient pressure the plungers $\mathbf{15}_A$, $\mathbf{15}_B$ and cylinders $\mathbf{17}_A$, $\mathbf{17}_B$ may together constitute a single sub-system and share a single one-way inlet between them.

In another variation one of the pumps A, B, C, D might be replaced by an alternate, potentially lower cost, pump that does not have a variable stroke length in which case the stroke length of the other pumps might be varied in relation to the stroke of the fixed-stroke pump. Indeed, the illustrated principles can be applied to a pumping system having no variable-stroke sub-systems, e.g. a bore diameter of the pumps A, B, C, D might decrement along the sequence by amounts corresponding to the compressibility of the fluid in the high-pressure/low-flow mode.

Systems having at least one variable-stroke pumping sub-system are preferred in that they are suited to more advanced control strategies to better share the pumping burden between the sub-systems; e.g. whilst a simple implementation may entail each sub-system having a respective fixed stroke length for each of the operating modes, other control strategies may take account of feedback, e.g. feedback from pressure and/or temperature sensor(s), to dynamically vary the stroke length(s) of one or more of the sub-systems by shifting one or both end points of the stroke. For example, in one example where it is desirable to maximise the output of the pumping system, the stroke length of each sub-system could be controlled in response (e.g. in negative relation to) a temperature of its respective drive unit, whereby each drive unit could be worked to its maximum sustainable temperature. The temperature of the drive unit could be measured via a sensor and/or inferred from data related to the impedance of the drive unit's windings.

In other examples, e.g. wherein the life of the ball screw is a limiting factor by which service intervals are determined, it may be desirable to control each of the stages to deliver a constant force. In yet other examples, it may be desirable to cause each sub-system to deliver a common amount of fluid power.

In the illustrated example the mechanism in which power from a preceding chamber is utilised to pump fluid takes the form of a unit for transmitting power from one chamber to another. In another example a sub-system that is powered during its intake stroke may utilise the power from that intake stroke during its compression stroke e.g. a sub-system could take the form of a simple single piston compressor driven by an internal combustion motor and having a flywheel mass which flywheel mass is accelerated by the fluid power during the intake stroke then returns that power to the fluid during the compression stroke. With such a pump, the preceding parallel-series principles disclosed herein could be implemented in a simple two-cylinder system.

According to preferred variants of the described systems, the described phase shifting is sufficient to change between the described modes and thereby change the pressure flow characteristics of the pumping system. Advantageously the cost associated with dedicated control valves (etc) can be avoided by making better use of the drive-control arrangements; e.g. there are no electromechanical control valves along any flow path connecting any adjacent two sub-systems. Indeed, preferred forms of the system do not include any electronically switchable valves. This advantageously eliminates a number of potential failure points and thereby improves reliability and reduces maintenance costs relative to switching between parallel and series operation by switching a multitude of electromechanical valves.

The pumping arrangement 1 is well adapted to pumping against variable resistances such as pressuring a vessel. The present inventors have considered one application that entails pressuring a vessel to 87 ksi to process food. On the basis that the food contained in the vessel has similar properties (compressibility) to water, an additional 12% of water must be pumped into the vessel. The pressure against which the pump must work ranges from zero (atmospheric) pressure at the outset to 87 ksi at completion. Using a variant of the arrangement 1 in which the plungers each have a diameter of about 32 mm acceptable filling times are achievable.

Plunger diameters of (approximately) 14 mm, 15 mm, 16 mm, 17.5 mm and 19 mm are also contemplated as are stroke lengths in the range of 120 mm to 170 mm. Maximum plunger speeds in the vicinity of 350 mm per second corresponding to a stroke rate of about 55 cycles per minute are also contemplated.

FIGS. 5 to 8 illustrate yet another alternate implementation of the principles disclosed herein. The system 100 includes the pumps A, B, C, D connected by an alternate plumbing arrangement. The pumps A, B, C, D are fluidly connected end to end. Of course, they need not be physically end to end. The connecting conduits could be curved, etc. FIG. 6A illustrates plumbing by which the pump A is connected to the pump B. Each adjacent two of the pumps B, C, D are mutually connected by a similar plumbing arrangement.

A conduit $\mathbf{133}_{AB}$ mutually connects cylinders $\mathbf{17}_A$, $\mathbf{17}_B$ so that those two cylinders are at substantially the same pressure throughout all modes of operation. An inlet $\mathbf{135}_{AB}$ connects the conduit 133 with an inlet rail 139. The inlet $\mathbf{135}_{AB}$ is equipped with a check valve $\mathbf{137}_{AB}$ and is thereby a one-way inlet. Likewise, an outlet $\mathbf{141}_{AB}$ connects the conduit $\mathbf{133}_{AB}$ to an outlet rail 145 and is equipped with a check valve $\mathbf{143}_{AB}$ so as to be a one-way outlet. The plungers $\mathbf{15}_A$, $\mathbf{15}_B$', cylinders $\mathbf{17}_A$, $\mathbf{17}_B$ and check valves $\mathbf{137}_{AB}$, $\mathbf{143}_{AB}$ together define an internal pressure space $\mathbf{147}_{AB}$ as suggested by hatching in FIG. 6A.

The first and last systems $\mathbf{15}_A$', $\mathbf{17}_A$' and $\mathbf{15}_D$, $\mathbf{17}_D$ are likewise connected between the inlet and outlet rails 139, 145 via check valves.

The system $15_A'$, $17_A'$ defines an internal pressure space $147_A$ and the system $15_D$, $17_D$ defines an internal pressure space $147_D$ each of which is akin to the pressure space $147_{AB}$.

Figures 5, 6A, 6B, 7, 8:
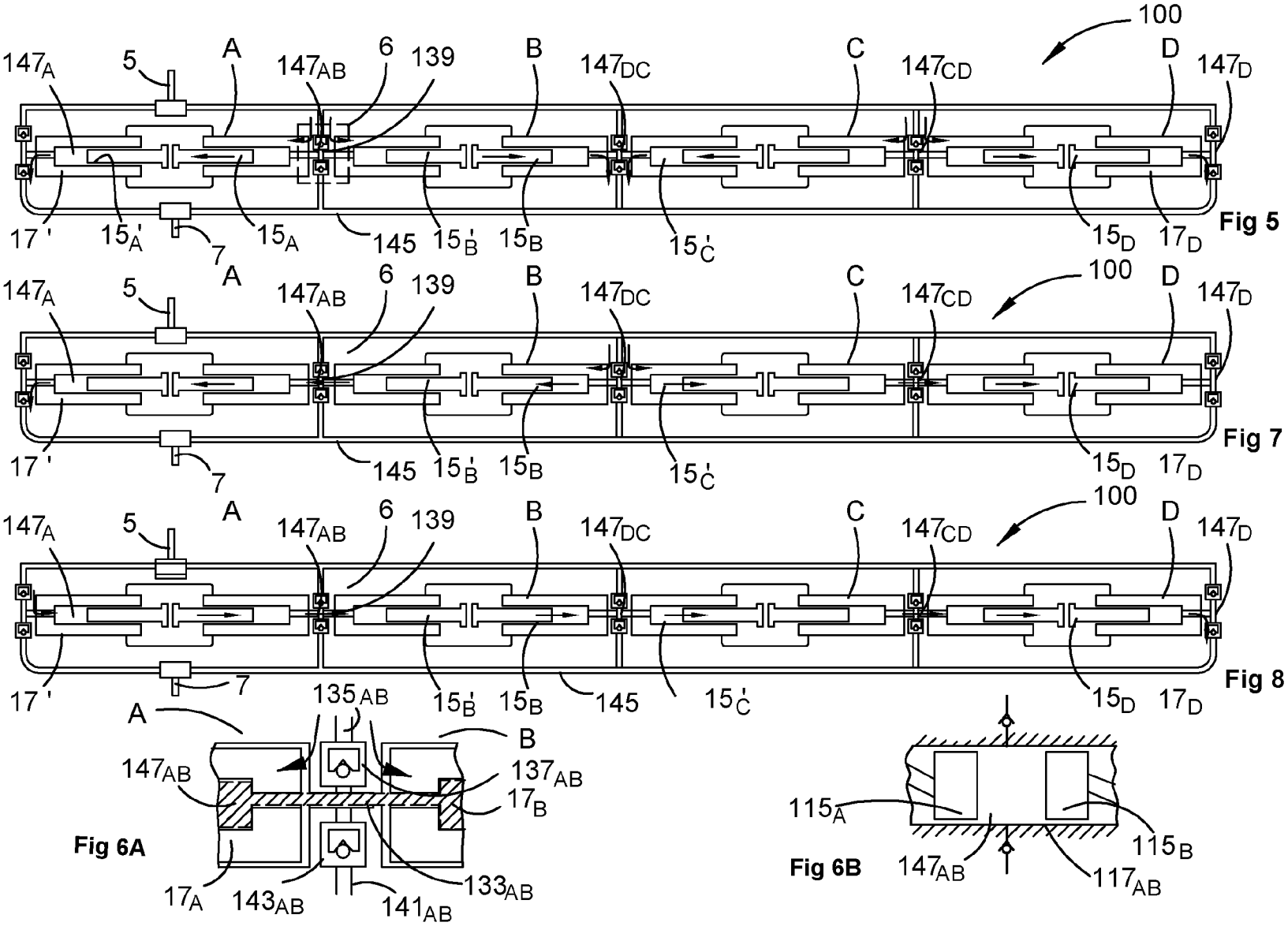
FIG. 5 illustrates another pumping arrangement in a first mode of operation.
FIG. 6A illustrates plumbing by which a pump A is connected to a pump B.
FIG. 6B illustrates a detail of a variant in which a pair of conrod driven pistons are mounted in opposition in a common bore to define a pressure space.
FIG. 7 illustrates the arrangement of FIG. 5 in a second mode of operation.
FIG. 8 illustrates the arrangement of FIG. 5 in a third mode of operation.

FIG. 5 illustrates the system 100 in a first mode of operation being a relatively high-flow low-pressure mode. Fluid is supplied to the intake rail 139 at about 32 litres per minute and about 100 psi via the inlet 5. Each adjacent two of the plungers is operated in phase with respect to each other, e.g. the plunger $15_A$ and plunger $15_B'$ are each on their intake strokes so as to increase the volume of the pressure space $147_B$ and thereby draw about 16 litres per minute of fluid into the pressure space $147_{AB}$ via the inlet $135_{AB}$. Mutually adjacent plungers $15_B$, $15_C'$ are each on their compression stroke whereby about 16 litres per minute of fluid at about 20 ksi is driven from pressure space $147_{BC}$. The plungers $15_A'$, $15_C$ are each on their compression stroke to each drive about 8 litres per minute of fluid towards the outlet rail 145.

As such, at the moment illustrated in FIG. 5

Fluid is being drawn into the pressure spacers $147_{AB}$, $147_{CD}$ at a combined rate of about 32 litres per minute; and Fluid is being expelled from the pressure spacers $147_A$, $147_{BC}$, $147_C$ at about the same rate to supply about 32 litres per minute at about 20 ksi to the outlet 7.

FIG. 7 illustrates the system 100 in an intermediate flow/intermediate pressure mode in which the plungers $15_A$, $15_B'$ are operated in antiphase to each other. At the moment illustrated in FIG. 7 the plunger $15_B'$ is on its compression stroke whilst the plunger $15_A$ is on its retraction stroke the length of which is adjusted to hold the pressure space $147_{AB}$ at about 20 ksi to power the pump A to deliver to the rail 145 fluid from the pressure space $147_A$ at about 8 litres per minute at about 40 ksi whilst the drive $19_A$ only has to work against a pressure difference of about 20 ksi. The adjacent plungers of the pumps C, D are likewise operated in antiphase to each other whereby the pressure space $147_{CD}$ does not itself act as a pumping chamber mutually connecting the rails 139, 147 but instead serves as a fluid-power transmission by which the pump C powers the pump D. The adjacent plungers of the pumps B, C are operated in phase with each other whereby at the moment illustrated in FIG. 7 about 16 litres per minute of fluid is drawn into the pressure space $147_{BC}$ and upon reversal of the stroke direction fluid is pumped from that space at about the same rate to the rail 145.

FIG. 8 illustrates the system 100 in its high-pressure/low-flow mode in which each adjacent two of the plungers are operated in antiphase to each other so that the intermediate pressure spaces $147_{AB}$, $147_{BC}$, $147_{CD}$ form fluid-power transmissions akin to the spaces $147_{AB}$, $147_{CD}$ in the intermediate mode.

In the high-pressure/low-flow mode only the spaces $147_A$, $147_D$ convey fluid from the rail 139 to the fluid $145_B$. In the moment illustrated in FIG. 8 the pump D receives power from the pumps A, B, C, D to enable it to deliver about 8 litres per minute at about 80 ksi. At this moment the pressure in the intermediate pressure spaces $147_{AD}$, $147_{BC}$, $147_{CD}$ are held at about 20 ksi, 40 ksi and 60 ksi respectively, whereby each of the drive mechanisms works against only an about 20 ksi pressure difference.

FIG. 6B illustrates a detail of a variant of the system 100 in which a pair of conrod driven pistons 115A, 1158 are mounted in opposition in a common bore $117_{AB}$ to define the pressure space $147_{AB}$.

Figure 9:
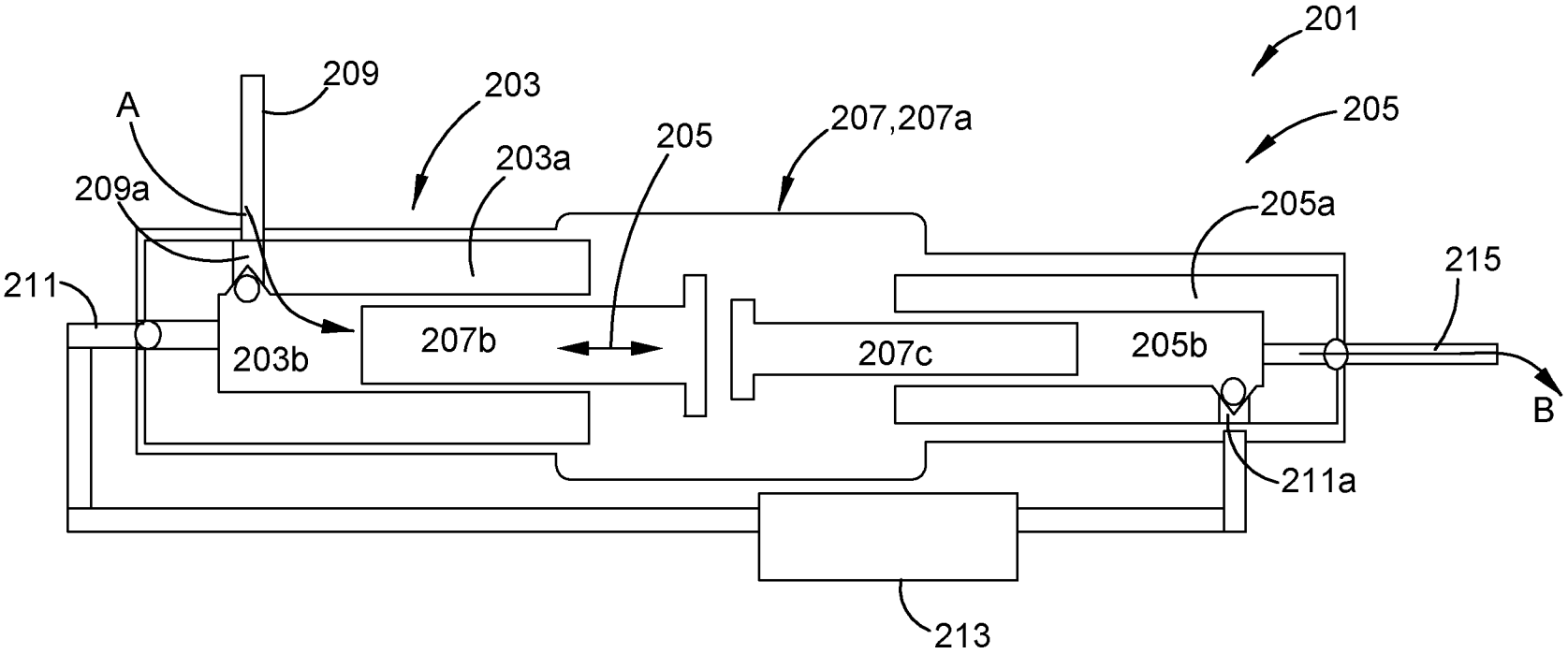
FIG. 9 is an axial cross-section view of an exemplary pump.

The pump 201 of FIG. 9 is a two-stage pump including a first stage 203 serially connected to a second stage 205. By way of example, each of the stages 203, 205 may be defined by a respective gas head. A drive arrangement 207 in the form of a linear actuator 207*a* drives both stages 203, 205.

The stages are driven in antiphase to each other, i.e. when the first stage is on its intake stroke, the second stage is on its outlet stroke and vice versa. The first stage 203 includes a cylinder 203*a* in which a plunger 207*b* is received to define a pumping chamber 203*b*. The plunger 207*b* is stroked (i.e. moved back and forth) by the drive arrangement 207 to pump fluid through the chamber 203*b*.

An inlet 209 opens into the chamber 203*b*. The inlet 209 is equipped with a check valve 209*a* and as such is a one-way flow inlet.

The plunger 207*b* is one end of a unit. The other end of the unit is formed by a plunger 207*c*. The plunger 207*c* is received within a cylinder 205*a* to define a chamber 205*b*. Advantageously, a cross-sectional area of the plunger 207*b* is larger than the cross-sectional area of the plunger 207*c*. In this example, the first stage has a capacity (i.e. swept volume) of about 2 L whilst the second stage has a capacity of about 1 L.

A screw (not shown) connects the plungers 207*b*, 207*c* to each other and is embraced by a nut arrangement (not shown). Preferably the nut and screw are together a ball screw arrangement. Most preferably the nut is embraced by a stator coaxial to the screw to form a drive akin to the $19_A$.

A sensor is provided to provide an indication of the position of the unit 207*b*, 207*c*. In this case, the sensor takes the form of a Renishaw LM10 incremental encoder arranged to measure the rotation of the nut arrangement. That rotation is an indication of the position of the unit 207*b*, 207*c* in that it is relatable to the position of the unit via the pitch of the ball screw. Preferably the ball screw has a 25 mm pitch. Of course, other forms of sensor are possible—a linear encoder may be used to directly measure the position of the unit 207*b*, 207*c*, or some arrangement of proximity switches may be effective. Indeed, feedback from the motor itself may be useful. Potentially the unit 207*b*, 207*c* might be periodically homed against one end or the other to calibrate the position-monitoring system.

The drive arrangement 207 preferably includes a control arrangement responsive to this position feedback whereby the motor, sensor and control arrangement together form a servo motor.

An outlet 211 from the chamber 203*b* carries the pumped fluid to a heat exchanger 213 and onwards to the chamber 205*b*. The conduit 211 is equipped with a check valve 211*a* and as such constitutes a one-way flow path. Reciprocal operation of the second stage 205 pumps fluid from the conduit 211 to an outlet conduit 215.

In operation, the unit 207*b*, 207*c* is stroked along the stroke S. FIG. 9 illustrates the unit 207*b*, 207*c* being moved to the right, corresponding to the intake stroke of the stage 203 as suggested by the arrow A and the compression stroke of the stage 205 as suggested by the arrow B.

When compressing fluids, the heat of compression can be problematic. If the pump is not properly controlled, the stages 203, 205 can overheat, potentially resulting in damage such as damage to a seal between the cylinder 203*a* and the plunger 207*b* and/or damage to the check valves. Cooling water is supplied to the heat exchanger 213 to cool the fluid en route from the first stage 203 to the second stage 205. Nonetheless, the present inventors have recognised that the temperatures resulting from the heat of compression can be a limiting factor, and that when existing control strategies are implemented to limit the hottest end of the pump to an acceptable temperature, inevitably the other end of the pump will be cooler and therefore more than likely used to less than its full potential.

The present inventors have recognised that the two ends of the pump can be balanced and thereby more efficiently utilised by varying at least one end point of the stroke S. The shift may be to further balance other aspects of the system. In one example, the average load on each end may be balanced to achieve equal wear and loading on either end to maximise product life.

In one convenient implementation, a temperature of the second stage 205 may be measured at any convenient location (e.g. along the outlet conduit 215). This feedback can be provided to the control arrangement of the drive arrangement 207 to enable the control arrangement 207 to vary a stroke rate to hold the second stage 205 at a desirable temperature.

At the same time, a temperature of the first stage may be measured (e.g. at any convenient location upstream of the heat exchanger 213) and an end point of the stroke S adjusted to regulate that temperature.

Preferably it is the end point of the compression stroke of the plunger 207*b* that is limited so as to control the end clearance between the plunger 207*b* and the end of the chamber 203*b*. Since, in this example, the plungers 207*b*, 207*c* are part of a common unit, controlling the end point of the compression stroke of the first stage inherently also entails varying the start point of the compression stroke of the second stage 205. Of course, a change of a few millimetres at the end of a compression stroke has a far more significant impact on the compression ratio of a particular stage than the same variation of a few millimetres at the start of a stage's compression stroke.

In this way, the temperatures at the ends of the pump may be relatively controlled (i.e. controlled relative to each other). This relative control may entail controlling one, or the other, or both of the ends of the pump. The relative control may be to equalise the temperatures at the ends of the pump. Alternatively, a fixed relativity may be maintained. By way of example, in some applications the seals at the lower-pressure end of the pump may be capable of withstanding higher temperatures than the seals at the higher-pressure end in which case it may be desirable to hold the temperature of the lower-pressure end a fixed proportion or amount above the temperature of the higher-pressure end so that both pumping chambers are used to their full potential.

Other implementations of the concept are possible. By way of example, instead of the two temperature sensors mentioned above, the end clearance(s) might be controlled in response to:

- pressure transducers indicating the output pressure of each cylinder, e.g. a trio of pressure sensors may be associated with the conduits 209, 211 and 215;
- feedback from the drive arrangement 207, e.g. to equalise the amount of mechanical work performed on each stroke;
- other variables; or
- some combination of two or more of the previously mentioned potential inputs.

In operation of the pump 201 gas may be

- supplied via the inlet 209 at 100 psi and about ambient temperature;
- pumped through the chamber 203*b* to about 600 psi and about 200° C.;
- cooled through the heat exchanger 213 to about ambient temperature; and then
- pumped through the chamber 205*b* to about 700 psi and 200° C.

A further heat exchanger (not shown) may be mounted along the outlet path to cool the fluid, for example en route to a vessel that is being filled.

The present inventors have recognised that balancing the output pressures of the cylinders of a multi-cylinder pump can be problematic. If the pump is not properly controlled, the output pressure of the first stage may reach its maximum pressure limit before the desired output pressure from the final stage is achieved.

The balance of pressures is complicated. It depends on the incoming fluid pressure and temperature, as well as the developed compression ratio in each stage, as well as the cooling of the intermediate stage.

In practice, the incoming pressure (e.g. the pressure at inlet 209) can be highly variable, depending on the equipment supplying the gas to the pump, and can have a large effect on the output pressure from the first stage.

For example, the system may be optimised for 100 psi incoming pressure, such that the inter-stage pressure just remains below its maximum pressure of 700 psi. If the incoming pressure is however increased to 150 psi, with all other factors remaining fixed, then the inter-stage pressure will exceed the maximum of 700 psi.

The present inventors have recognised that when existing control strategies are implemented to limit either end of the pump to be within their maximum pressure envelope the other end may not be utilised to its full capacity.

Preferred forms of the various disclosed apparatus are suited to pumping gases such as nitrogen, butane, hydrogen, carbon dioxide and oxygen. For example, a variant may be used to pump butane gas used in the extraction of oil from marijuana leaves, or to compress the gas coming off a hydrogen reformer. Other embodiments could be used for compressing gases for feedstock for an ethylene plant. Indeed, some variants may be configured to pump liquid, e.g. water for liquid-cutting such as waterjet cutting.

In FIG. 9 the stages 203, 205 are mutually connected in series. In another example the two pumping chambers may be plumbed in parallel to each other. Indeed, other embodiments of the principles disclosed herein may take a form entirely different to the pump 201. By way of example, in the context of a single piston compressor driven by an internal combustion engine and a crank and conrod arrangement, the end points of the stroke of the cylinder relative to its cylinder may be varied by axially moving the cylinder and/or varying an effective length of the conrod. Such an arrangement may advantageously allow the internal combustion engine to continue operating at peak efficiency whilst the pressure faced by the pump varies.

The principles discussed in relation to FIG. 9 may also be applied to variants of the pumping systems disclosed in the preceding figures. By way of example, the temperatures of the check valves $\mathbf{27}_{AB}$, $\mathbf{27}_{BC}$, $\mathbf{27}_{CD}$, $\mathbf{27}_{D}$ may be monitored by suitable sensors and the stroke end points of the pumps A, B, C, D controlled, e.g. to limit the sensed temperatures to protect the seals of the pumping chambers. In a preferred form, a respective heat exchanger is positioned between each adjacent two of the sub-systems of the system 3.

Various control strategies may be implemented to shift the end point of a stroke. Various of the illustrated examples incorporate an encoder for providing feedback indicative of a position of the stroked element and in response to which the corresponding drive unit can be controlled to move the stroked element to a predetermined end point. Other implementations of the disclosed principles are possible without such an encoder or any similar positional feedback. By way of example:

the pump A may have position switches in response to which the stroked element $15_A$, $15_A'$ is reversed; and the drive units of the pumps B, C, D may be controlled to deliver a constant force and to simply reverse direction whenever the pump A reverses direction.

Through this logic, the end points of the strokes of the pumps B, C, D may be shifted. Of course, other control strategies that result in the end point being shifted are possible.

The invention is not limited to the illustrated examples. Rather, the invention is defined by the claims.

What is claimed is:

1. A method comprising:

pumping fluid with a pumping arrangement, which comprises:

a first system for pumping the fluid, the first system comprising:

a sequence of two or more sub-systems each being a respective positive-displacement sub-system and having a respective one-way inlet;

one or more one-way flow paths comprising a respective one-way flow path linking each adjacent two of the sub-systems; and a one-way outlet from a last of the sub-systems;

wherein the respective one-way inlet of each of the two or more sub-systems receives the fluid in addition to any fluid received from the one or more one-way flow paths;

wherein the pumping comprises:

operating the pumping arrangement in a first mode of operation in which at least some of the sub-systems are substantially in phase with respect to each other to cause the first system to draw the fluid from more than one of the one-way inlets; and operating the pumping arrangement in a second mode of operation in which at least some of the sub-systems are substantially in antiphase with respect to each other to increment a pressure of the fluid as the fluid moves along the sequence to cause the pumping arrangement to deliver the fluid at higher pressure and lower flow than the pumping arrangement delivers in the first mode of operation; and wherein at least one of the sub-systems has a variable stroke length; and wherein a ratio of a stroke length of at least one of the sub-systems to a stroke length of another of the sub-systems downstream of the at least one of the sub-systems is lower, for the first mode of operation than the ratio is for the second mode of operation, to compensate for compression of the fluid as the fluid moves along the sequence.

2. The method of claim 1 wherein in the first mode of operation all of the sub-systems are substantially in phase with respect to each other.

3. The method of claim 1 wherein in the second mode of operation the sub-systems of each adjacent two sub-systems of the two or more sub-systems are substantially in antiphase with respect to each other to increment the pressure of the fluid through each of the sub-systems.

4. The method of claim 1 wherein the sequence of two or more sub-systems comprises more than three of the sub-systems.

5. The method of claim 1 wherein the sequence of two or more sub-systems comprises four of the sub-systems.

6. The method of claim 5 wherein:

in the first mode of operation the four sub-systems are in phase with respect to each other;

the method comprises operating the pumping arrangement in an intermediate mode of operation in which:

a first adjacent two of the four sub-systems are substantially in phase with respect to each other; and a last adjacent two of the four sub-systems are substantially in phase with respect to each other and substantially in antiphase with respect the first adjacent two of the four sub-systems to deliver the fluid at higher pressure and lower flow than the pumping arrangement delivers in the first mode of operation; and in the second mode of operation, the sub-systems of each adjacent two of the four sub-systems are substantially in antiphase with respect to each other to deliver the fluid at higher pressure and lower flow than the pumping arrangement delivers in the intermediate mode of operation.

7. The method of claim 1 wherein two or more of the sub-systems in the sequence of two or more sub-systems are substantially identical to each other.

8. The method of claim 1 wherein all of the sub-systems in the sequence of two or more sub-systems are substantially identical to each other.

9. The method of claim 1 comprising the pumping arrangement automatically responding to feedback to deliver a target pressure when the first system is in at least one of the first mode of operation or the second mode of operation.

10. The method of claim 1 comprising the pumping arrangement automatically responding to feedback to deliver a target flow rate when the first system is in at least one of the first mode of operation or the second mode of operation.

11. The method of claim 1 comprising the pumping arrangement automatically responding to feedback, to maximize a delivery of the first system while maintaining one or more parameters of the first system within one or more respective limits, when the first system is in at least one of the first mode of operation or the second mode of operation.

12. The method of claim 1 comprising the pumping arrangement automatically responding to feedback to transition from the first mode of operation to the second mode of operation.

13. The method of claim 1 comprising the pumping arrangement automatically responding to feedback to equalize at least one parameter of at least one of the sub-systems with a corresponding parameter of at least one other sub-system of the sequence of two or more sub-systems.

14. The method of claim 13 wherein the at least one parameter of the at least one of the sub-systems and the corresponding parameter of the at least one other sub-system of the sequence of two or more sub-systems comprise a drive unit temperature.

15. The method of claim 1 wherein:

the pumping arrangement comprises a second system, comprising:

a sequence of two or more second-system sub-systems each being a positive-displacement sub-system and having a respective second-system one-way inlet;

a respective second-system one-way flow path linking each adjacent two of the second-system sub-systems; and a second-system one-way outlet from a last of the second-system sub-systems;

the pumping arrangement comprises double-acting pumps, each of which comprises:

a respective sub-system of the first system;

a respective second-system sub-system; and a respective drive arrangement for driving the respective sub-system of the first system and the respective second-system sub-system in antiphase to each other;

the first mode of operation is a mode in which at least some of the second-system sub-systems are substantially in phase with respect to each other to cause the second system to draw the fluid from more than one of the second-system one-way inlets of the second system; and the second mode of operation is a mode in which at least some of the second-system sub-systems are substantially in antiphase with respect to each other to increment a pressure of the fluid as the fluid moves along the sequence of the second-system sub-systems.

16. The method of claim 15 wherein:

each of the double-acting pumps includes:

a screw;

a nut engaged with the screw; and a drive for rotationally driving the nut; and pumping the fluid comprises rotationally driving the nut.

17. The method of claim 16 wherein the drive comprises a stator coaxial to the screw.

18. The method of claim 16 wherein the nut and the screw are together a ball screw.

19. The method of claim 1 wherein the pumping arrangement is capable of delivering the fluid at about 80 kilopounds per square inch (ksi).

20. The method of claim 1 wherein the pumping arrangement is capable of delivering the fluid at about 0.28 cubic feet per minute (cfm) (8 liters per minute (L/min)) and at about 80 kilopounds per square inch (ksi).

* * * * *